US005655386A

United States Patent [19]

Huang et al.

[11] Patent Number: 5,655,386

[45] Date of Patent: Aug. 12, 1997

[54] ICE CRUSHING AND FEEDING DEVICE FOR ICE MAKING APPARATUSES

[75] Inventors: Chuen-Lin Huang; Hsu-Cheng Chaing, both of Hsinchu, Taiwan

[73] Assignee: Industrial Technology Research Institute, Hsinchu, Taiwan

[21] Appl. No.: 394,960

[22] Filed: Feb. 27, 1995

[51] Int. Cl.[6] ..... F25C 5/18

[52] U.S. Cl. ..... 62/320; 62/344

[58] Field of Search ..... 62/320, 330, 344

[56] References Cited

U.S. PATENT DOCUMENTS

| | | | |
|---|---|---|---|
| 2,637,177 | 5/1953 | Reedall | 62/320 X |
| 2,730,865 | 1/1956 | Murdock | 62/320 X |
| 3,217,509 | 11/1965 | Weil et al. | 62/320 |
| 4,124,145 | 11/1978 | Spinner et al. | 62/344 X |
| 4,249,388 | 2/1981 | Burns | 62/330 X |
| 4,401,449 | 8/1983 | Martin et al. | 62/330 X |
| 4,922,724 | 5/1990 | Grayson et al. | 62/330 X |
| 5,005,364 | 4/1991 | Nelson | 62/330 X |

*Primary Examiner*—William E. Tapolcai

*Attorney, Agent, or Firm*—Beveridge, DeGrandi, Weilacher & Young LLP

[57] ABSTRACT

An ice crushing and feeding device located below an ice making apparatus including a V-shaped receiving means, an ice conveying mechanism, a speed control device, a crushing mechanism, an ice/chilled water mixing chamber and a feed pump for transferring solid/liquid mixtures. Ice produced by the ice making apparatus is guided by the receiving means into the conveying mechanism which by means of its rotational and pressing actions transfers the ice to the crushing mechanism to be crushed into fragments of a suitable size. The ice fragments are mixed with the chilled water in the mixing chamber at a predetermined proportion. The mixture is then transferred by the feed pump to each ice storage tank.

12 Claims, 7 Drawing Sheets

ICE CRUSHING AND FEEDING DEVICE FOR ICE MAKING APPARATUSES

FIELD OF THE INVENTION

The present invention relates generally to an ice crushing and feeding device, and more particularly to an ice crushing and feeding device for an ice making apparatus.

BACKGROUND OF THE INVENTION

FIG. 1 Shows a dynamic ice making apparatus which mainly comprises at least a plate-type or tubular evaporator 1. Cold refrigerant enters via a tube 11 into the evaporator 1 and exchanges heat with the chilled water or ice on the outer surface of the evaporator 1. After heat exchange, the refrigerant is vaporized into gas refrigerant due to absorption of heat. The gas refrigerant is then sucked in by a compressor contained in a refrigeration unit 12. After compression, cooling and expansion, the gas refrigerant becomes a cold refrigerant again and is recycled to the evaporator 1 for cooling purposes, forming a refrigerant recycling system.

As shown in FIG. 1, a chilled water feed tube 13 located above the evaporator 1 distributes chilled water downwardly to flow over the outer surface of the evaporator 1. As the chilled water flows downwardly thereover, its heat is absorbed by the cold refrigerant inside the evaporator 1 and a layer of ice is thus formed on the outer surface of the evaporator 1. When the ice has built up to a certain thickness (generally between 6 and 10 mm), it has to be removed into a container. The conventional defrosting method is to conduct high-pressure hot gas refrigerant discharged from an outlet of the compressor into the evaporator 1 via a hot gas tube 14 so that the thin layer of ice in direct contact with the hot surface of the evaporator 1 is melted and pieces of ice fall into a storage tank 15 below. Compared with other types of ice storage systems, the evaporation temperature of the refrigerant in the ice storage system of the dynamic ice making apparatus may be increased to −6 degrees Celsius, hence the capacity and energy efficiency of its compressor must be excellent. Besides, since the ice is stored separately from the evaporator 1, the dynamic ice making apparatus may be used not only in air-conditioning systems hut also in food refrigeration and industrial processes to reduce power load during peak hours. The dynamic ice making apparatuses are usually available in packages and their size is determined by manufacturers, not end users. In order to use an available dynamic ice making apparatus, the end user must prepare an ice storage tank of a considerable depth to accommodate the size of the apparatus. The deeper (generally more than 6 m) the tank, the better the performance, but such deep tanks are not very suitable for installation in existing buildings. In view of this drawback, dynamic ice making apparatuses have limited applications. Elimination of this drawback and improvement in conventional ice making apparatuses are therefore necessary.

In the conventional ice making apparatus, the ice storage tank 15 is located below the ice making apparatus, and the ice falls directly into the storage tank 15. Because of this arrangement, the ice is unevenly distributed and accumulates into a heap such as that shown in FIG. 1, hence reducing the effective capacity of the storage tank 15. Additionally, every ice making apparatus has only a single ice storage tank, which is very uneconomical in terms of effectiveness.

Some types of conventional apparatuses have improved storage tanks such as that shown in FIG. 2, wherein a screw propeller means mounted at an upper end of the storage tank 15 distributes the falling ice to the corners of the storage tank 15 so as to prevent the ice from piling into a heap. But such a design is only suited for storage systems with a single storage tank. There are also restrictions on the height and shape of the storage tank.

In the conventional ice storage system having a single storage tank, the ice storage tank 15 occupies a huge area, which is a burden because land is limited and very expensive in large cities. Moreover, it is not possible to have the storage tank and the main body of the ice making apparatus separately installed using the known art, and users are discouraged from procuring such apparatuses. It is therefore necessary to solve the problems of utilizing existing building structures (e.g., raft foundations) in the installation of ice making apparatuses and improving the arrangement of the main body of the apparatus and the ice storage tank so as to attract users.

SUMMARY OF THE INVENTION

A primary object of the present invention is to provide an ice crushing and feeding mechanism adapted for use in a multiple ice storage tank system wherein raft structures of existing buildings are modified to form storage tanks, effectively using available construction space and reducing installation cost, and wherein the main body of the ice making apparatus and the ice storage tanks may be separately installed so that the apparatus may be used in various situations, enhancing its flexibility and applicability.

To achieve the above-mentioned object of providing a multiple ice storage tank system in cooperation with a single ice making apparatus, the ice crushing and feeding mechanism of the present invention may be adopted. A screw propeller conveying means is provided below an ice outlet of the ice making apparatus, and the ice is first conveyed to the crushing mechanism to be broken into fragments of an appropriate size before being transferred to an ice/chilled water mixing chamber. By means of a feed pump, the mixture of ice and chilled water is distributed via distribution pipings into each storage tank.

An ice/chilled water mixing chamber is arranged below the ice crushing mechanism. This chamber is located below the water level of the chilled water storage tank and is connected to an inlet of a feed pump so that all the fragmented ice may he sucked into the feed pump. The screw propeller conveying means may, by means of a speed controller, adjust its rotational speed. As the screw propeller conveying means has a pressing function, when it rotates speedily, the amount of ice output from its outlet is comparatively greater than when it rotates slowly, the amount of ice output is comparatively less. By means of this design, the amount of fragmented ice to be fed into the ice/chilled water mixing chamber at the outlet end of the conveying means may be regulated to ensure the proportion of ice to be mixed with chilled water from the chilled water tank so that the ice fragments may not block the smooth passage of the mixture through the distribution pipings.

Employing the ice crushing mechanism of the present invention at the outlet of the dynamic ice making apparatus may help enhance the effective use of an ice storage tank, and use of multiple ice storage tanks is also made possible thereby.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
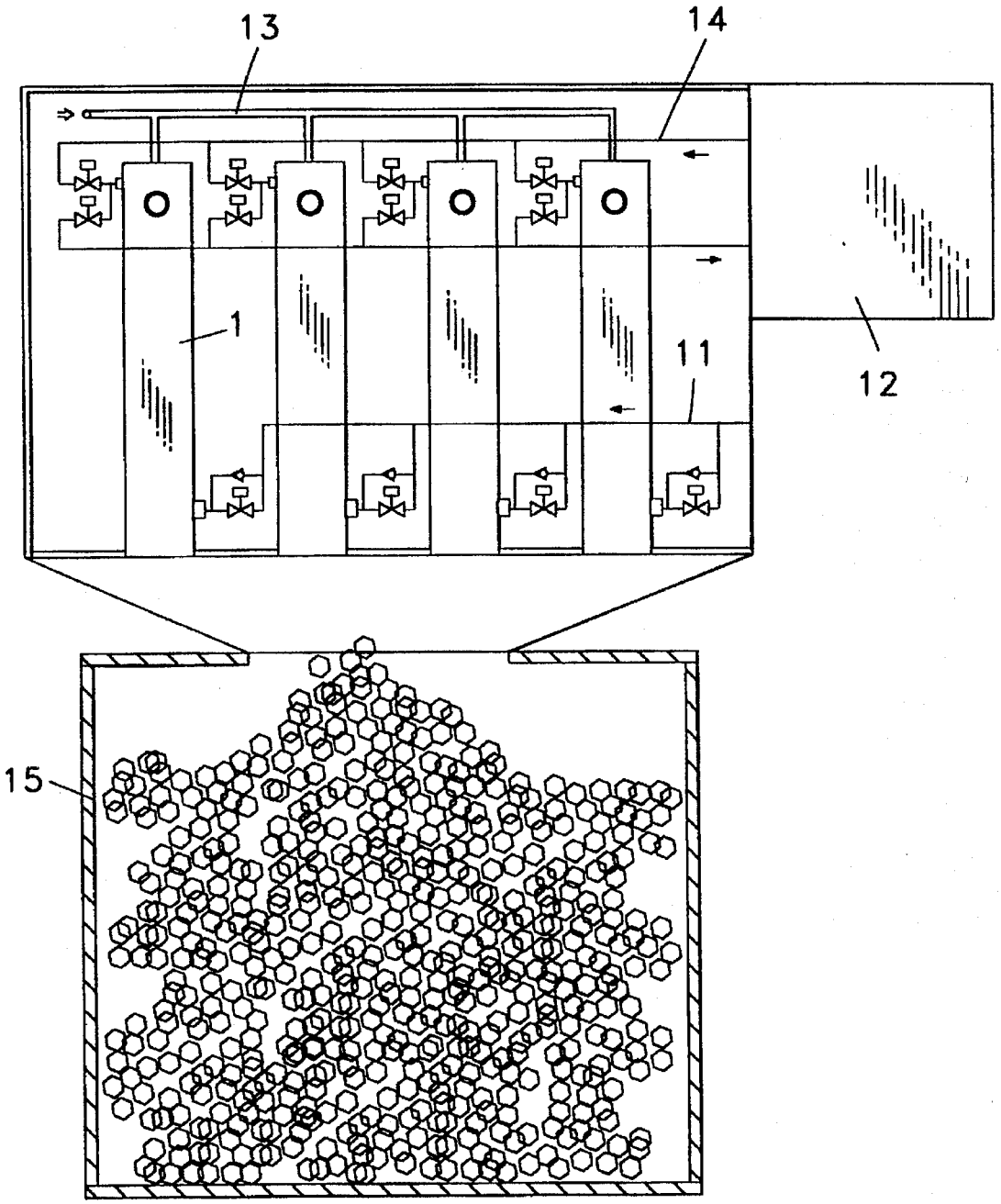
PRIOR ART FIG. 1
FIG. 1 is schematic view of the conventional ice making apparatus and a unitary storage tank, showing a heap of ice in the storage tank.
Figure 2:
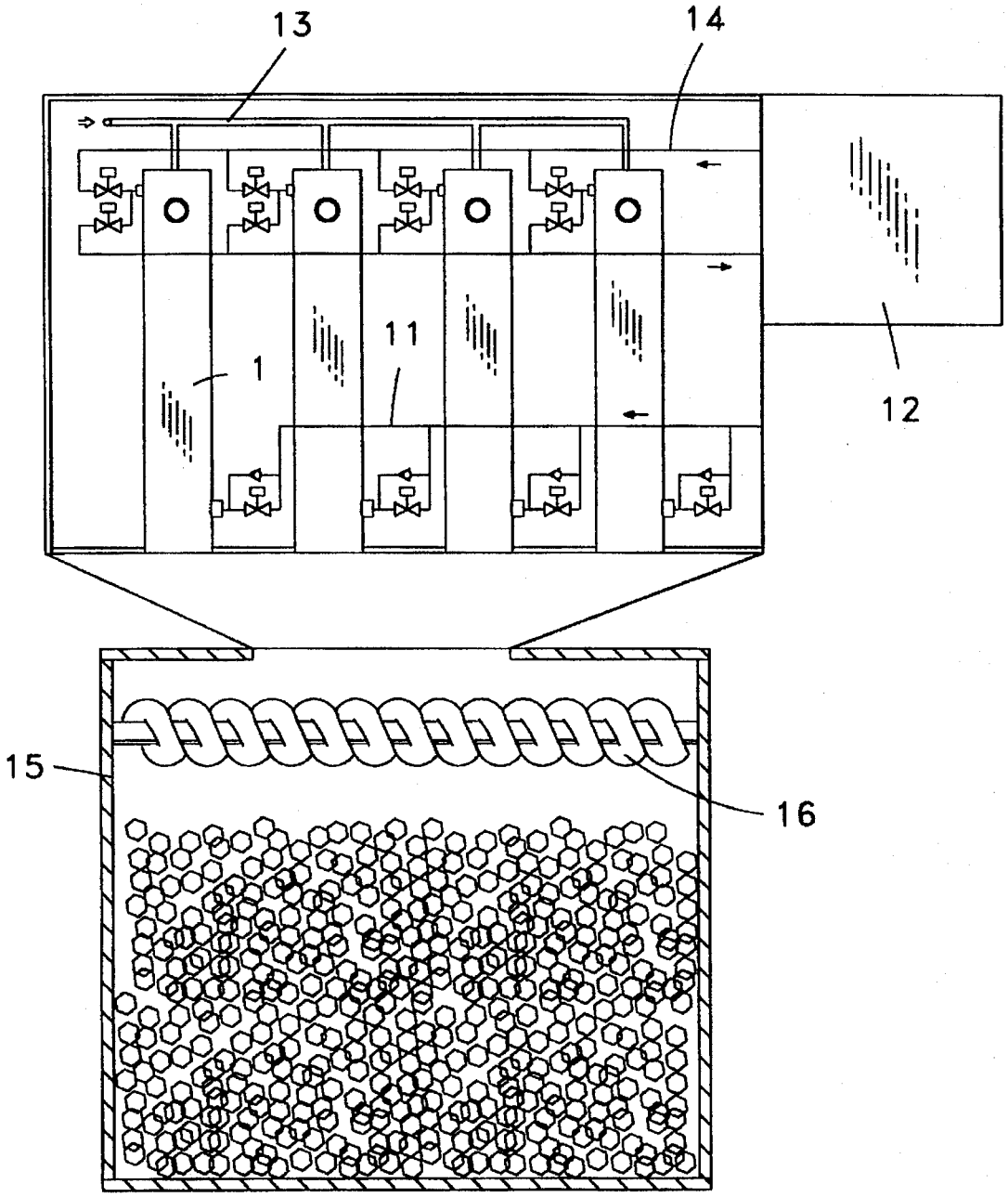
PRIOR ART FIG.2
FIG. 2 is similar to FIG. 1, but showing another conventional ice storage tank.
Figure 3:
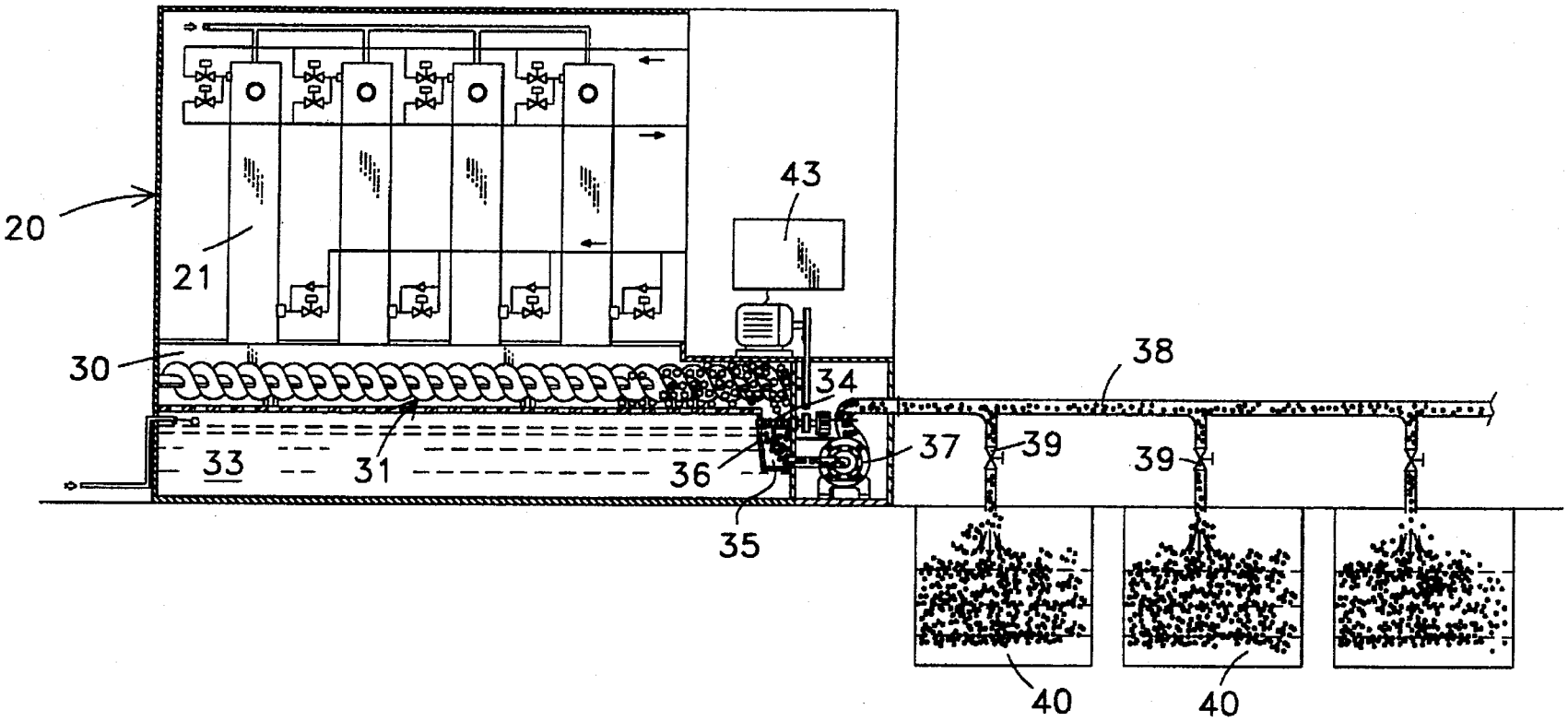
FIG. 3 is a schematic view of the present invention.
Figure 4:
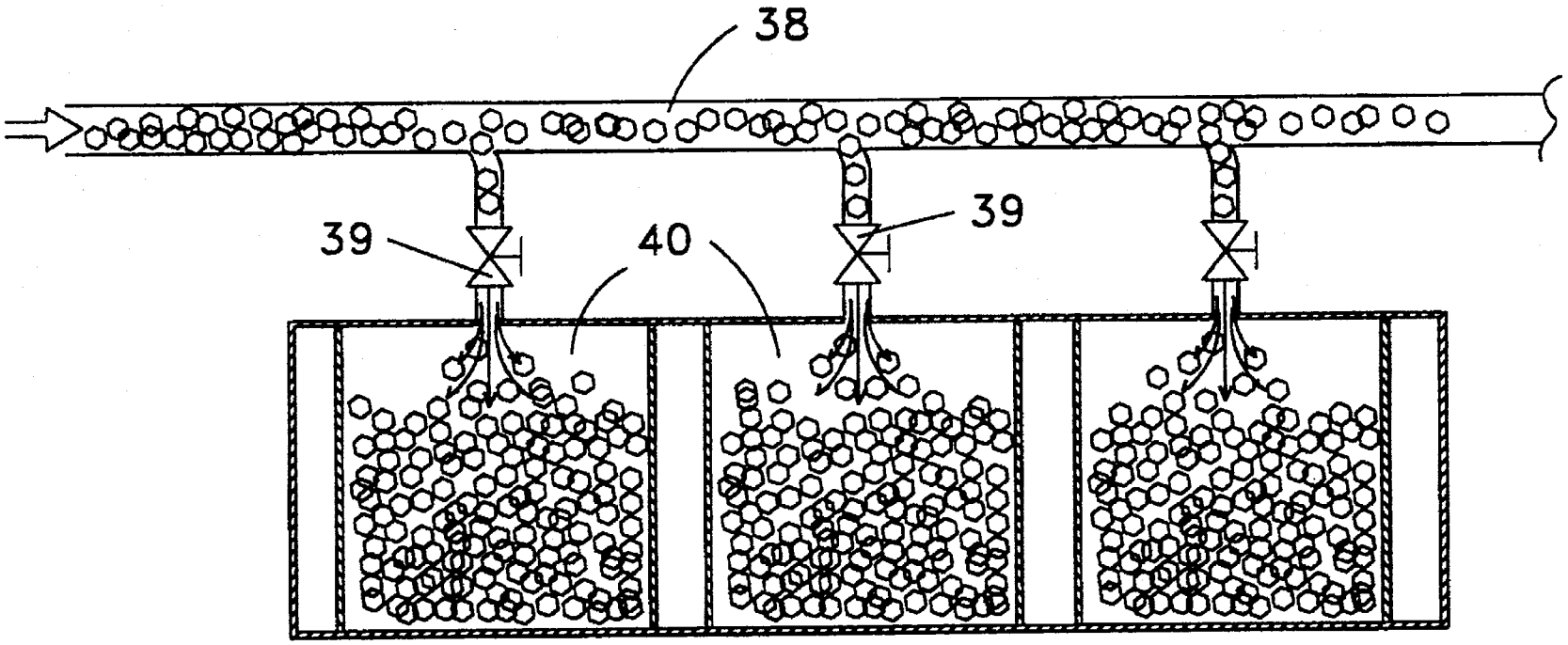
FIG. 4 is a partially enlarged view of the multiplicity of ice storage tanks shown in FIG. 3.
Figure 6A:
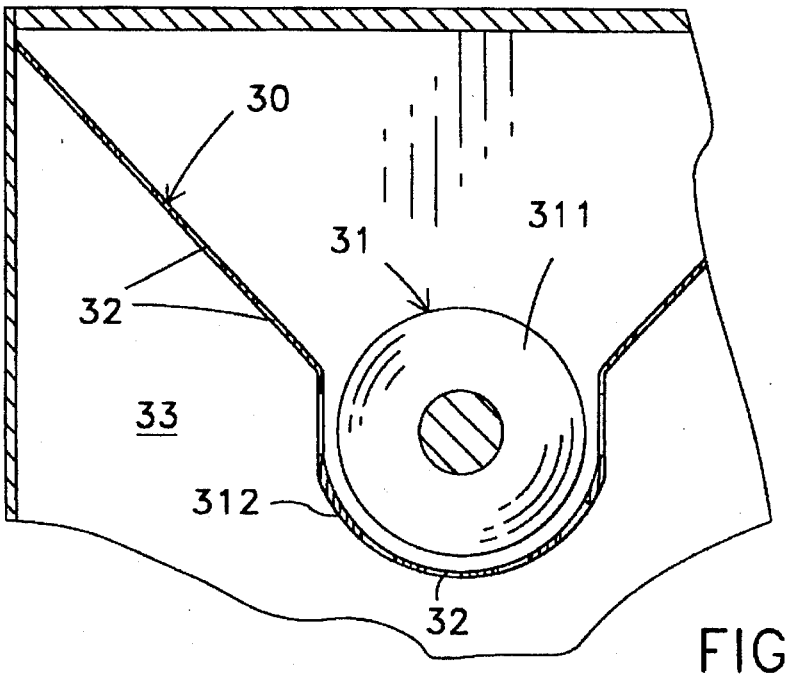
FIG. 6A is a partially enlarged sectional view of the ice crushing and feeding device taken along line 6A—6A of FIG. 5.
Figure 6:
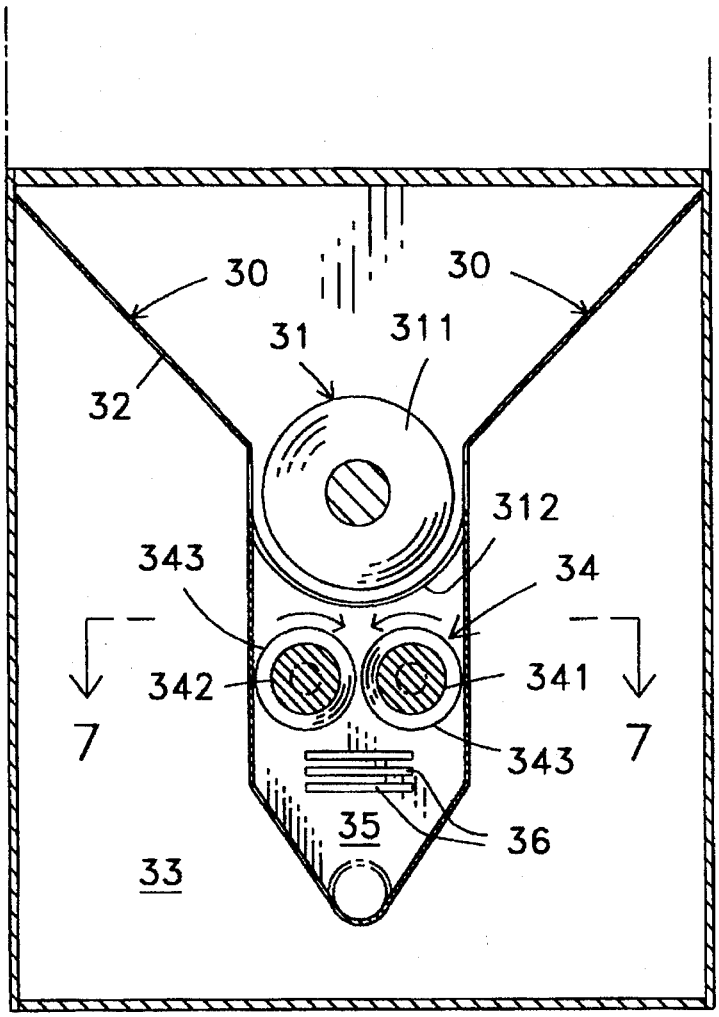
FIG. 6 is a sectional view taken along line 6—6 of FIG. 5.
Figure 7:
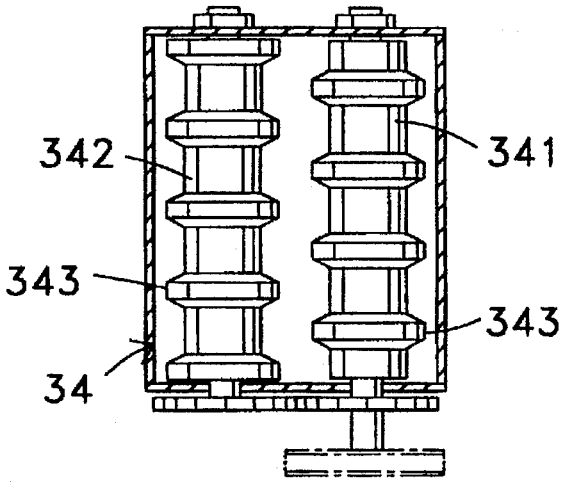
FIG. 7 is a sectional view taken along line 7—7 of FIG. 6.

As shown in FIG. 3, an ice crushing and feeding device of the present invention is installed right below an ice outlet of a dynamic ice making apparatus 20. The device has a V-shaped receiving means 30 consisting of a couple of oblique plates as shown in FIG. 6. They are used for receiving and guiding fragmented ice falling from an evaporator of an ice making apparatus 20. The ice may be easily collected into an ice conveying mechanism 31, such as a screw propeller conveying mechanism. Both the V-shaped receiving means 30 and a bottom shell 312 of the screw propeller conveying mechanism 31 (as in FIG. 6A) have holes 32 which allow chilled water from the ice making apparatus 20 to flow directly into a chilled water storage tank 33 during the ice making process. The ice from the ice making apparatus 20 is then pushed to move along a space between the bottom shell 312 and a screw propeller conveying rod 311 of the screw propeller conveying mechanism 31; the bigger pieces of ice are first of all broken down into smaller pieces during the pushing process. At an end of the conveying mechanism 31, the ice is further pushed to an ice crushing mechanism 34 below (as shown in FIGS. 6 and 7). By means of two rollers 341 and 342 of the crushing mechanism 34, the fragmented ice crushed into finer ice fragments of a size suitable for transference by a feed pump 37. The ice fragments are then sent to an ice/chilled water mixing chamber 35 located at the bottom of the feed pump 37 to mix with an appropriate proportion of chilled water which is drawn in from a chilled water storage tank 33 via a hole 36. The proportion of chilled water and ice fragments inside the ice/chilled water mixing chamber 35 is controlled by the pushing speed of the screw propeller conveying mechanism 31. By means of the action of a speed control device 43, the rotational speed of the screw propeller rod 311 may be adjusted, further controlling the amount of chilled water and ice fragments entering the ice/chilled water mixing chamber 35 per unit time. The feed pump 37 may then be operated under normal operating conditions, and suitable mixing ratios of the ice fragments and chilled water in a distribution duct 38 may also be obtained, eliminating possible blockage of the distribution duct 38. The distribution duct 38 is a normal chilled water piping. By using valve elements 39 in the piping, ice fragments may be distributed into several ice storage tanks 40 as desired. Because of the arrangement of the device of the present invention, the dynamic ice making apparatus 20 is no longer limited to the employment of a single ice storage tank 40, and it is no longer necessary to install the ice making apparatus 20 above the ice storage tank 40, which may be placed in any suitable space in a building as desired. In metropolitan cities where land is expensive and space has to be efficiently used, the present invention provides a good solution to existing drawbacks in conventional ice making apparatuses.

The device of the present invention mainly comprises the screw propeller conveying mechanism 31, the ice crushing mechanism 34, the chilled water storage tank 33 and the feed pump 37. Ice fallen from the ice making apparatus 20 is transferred via the screw propeller conveying mechanism 31 to the ice crushing mechanism 34 for crushing. Fragmented ice of a uniform size is mixed with chilled water supplied by the chilled water storage tank 33 in the ice/chilled water mixing chamber 35. Then the mixture is sent via the feed pump 37 to each ice storage tank 40.

The screw propeller conveying mechanism 31 includes the screw propeller conveying rod 311 and the bottom shell 312. The screw propeller conveying mechanism 31 is disposed at the meeting point of the two oblique plates of the V-shaped receiving means 30 disposed below the ice making apparatus 20. When the ice falls from the outer surface of the evaporator of the ice making apparatus 20 into the V-shaped receiving means 30 and subsequently slides along the oblique plates onto the screw propeller conveying mechanism 31, due to the push action generated by the rotation of the screw propeller conveying rod 311 and the restriction of the bottom shell 312, the ice is pushed to the right into the ice crushing mechanism 34. During the above-mentioned pushing process the ice may be crushed into smaller fragments, but the ice still has to pass through the ice crushing mechanism 34 to be broken into finer fragments of a size suitable for transference by the feed pump 37 to the ice storage tanks 40.

The object of the design of the ice crushing mechanism 34 is to ensure that the size of the ice fragments entering the feed pump 37 meets the normal operating requirements of the feed pump 37. Therefore, any device which may achieve the object of crushing the ice into tiny particles suitable for conveyance by the feed pump 37 may he adopted. As shown in FIGS. 6 and 7, the device employed in the present embodiment is a set of rollers 341 and 342. These rollers are each provided with a multiplicity of spaced flanges 343 or blades, the choice of which depends on the size of the ice fragments desired. During the process of crushing, shafts of the rollers 341, 342 rotate in opposite directions, so that ice fragments are drawn in between the rollers 341, 342 to be crushed into finer particles which are then smoothly conducted into the ice/chilled water mixing chamber 35.

Figure 5:
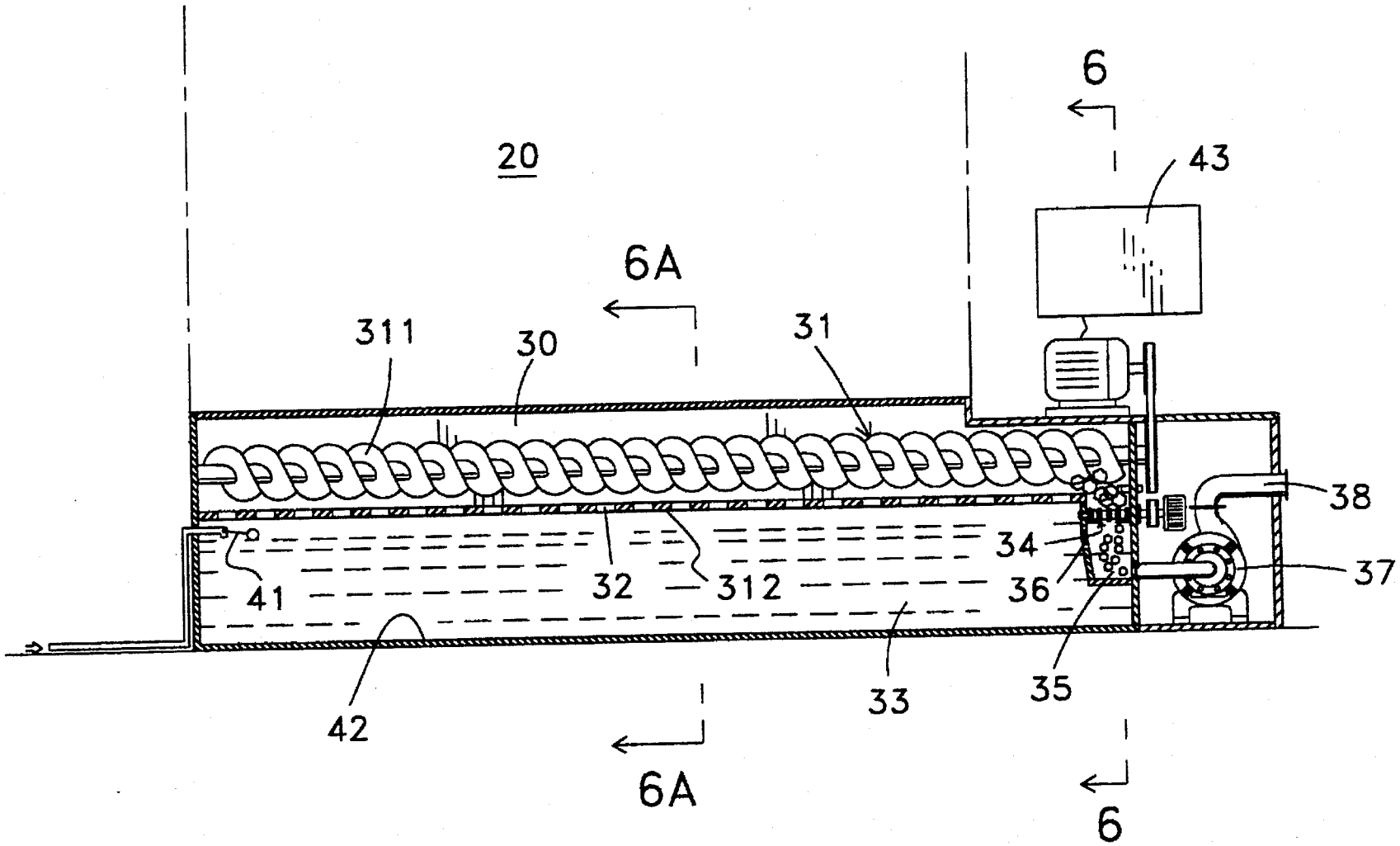
FIG. 5 is a partially enlarged view of the ice crushing and feeding device shown in FIG. 3.

As shown in FIG. 5, the chilled water storage tank 33 is located below the V-shaped receiving means 30 and has a float valve 41 and a tank body for holding chilled water. The float valve 41 controls the level of the water in the tank body 42 so as to supply a stable amount of chilled water to the ice/chilled water mixing chamber 35, the feed pump 37 and distribution pipings.

The ice/chilled water mixing chamber 35 is connected to the outlet of the ice crushing mechanism 34. Ice fragments having passed through the ice crushing mechanism 34 enter the ice/chilled water mixing chamber 35 and mix with the chilled water flowing in via the hole 36 from the chilled water storage tank 33. By means of the pressing force of the ice crushing mechanism 34 located on top of the ice/chilled water mixing chamber 35, the ice fragments are mixed evenly with the chilled water. Then the mixture is distributed by the feed pump 37 via the distribution duct 38 to each ice storage tank 40. The hole 36 communicating with the ice/chilled water mixing chamber 35 and the chilled water storage tank 33 permits ice and chilled water into the ice/chilled water mixing chamber 35, but prevents ice fragments from entering into the chilled water storage tank 33 from the ice/chilled water mixing chamber 35.

Figure 9:
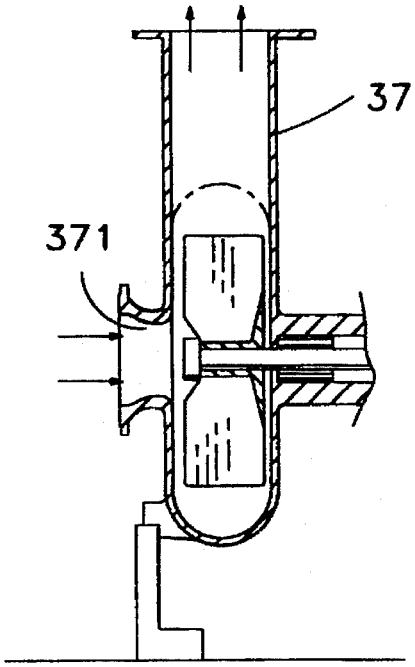
FIG. 9 is a side view of FIG. 8.
Figure 8:
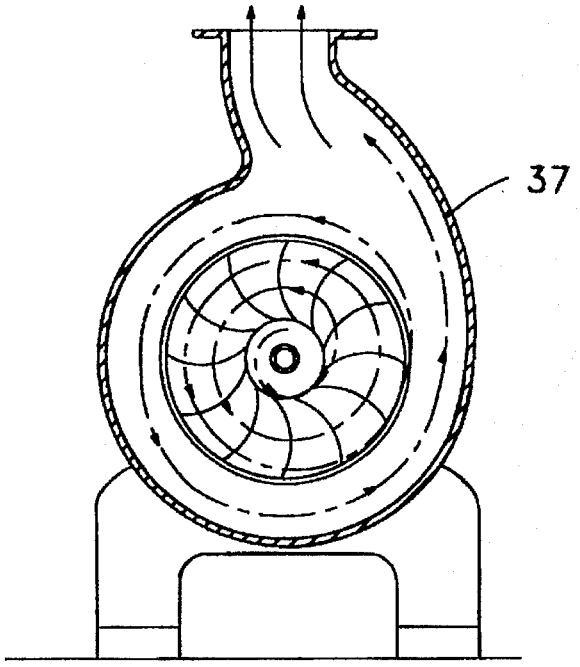
FIG. 8 is a partially enlarged view of the feed pump as shown in FIG. 3.

The feed pump 37 as shown in FIGS. 8 and 9 is a product of standard specifications, and it is generally known as a non-clogging pump. This type of pump has been widely used in petrochemical engineering, sludge transfer, wastewater treatment, and agricultural as well as fishery operations for transferring solid/liquid fluid mixtures. In this example, a pump using vortex force to drive the fluid is adopted. Due to the fact that solids do not come into contact with the impeller of the pump directly, a solid/liquid mixture being less than 30% solid may be transferred by an available product. A suction side 371 of the feed pump 37 and the outlet of the ice/chilled water mixing chamber 35 are interconnected. The distance between the suction side 371 and the outlet at the rear end of the screw propeller conveying mechanism 31 is very short, with only the ice crushing mechanism 34 disposed therebetween. By utilizing the pressing action of the screw propeller conveying mechanism 31 and the ice crushing mechanism 34 as well as the rotational force of the feed pump 37, crushed ice fragments may be drawn with the water current into the feed pump 37 to be transferred to the ice storage tanks 40.

By means of the speed control device 43, the rotational speed of the screw propeller conveying mechanism 31 may be adjusted to achieve the object of controlling the proportion of the ice fragments and chilled water so as to suit the piping conditions and piping length. When the rotational speed of the screw propeller conveying mechanism 31 is increased, the pressing force of the screw propeller conveying mechanism 31 is augmented, and the amount of ice transported to the ice/chilled water mixing chamber 35 is also increased. When the rotational speed of the screw propeller conveying mechanism 31 is decreased, the pressing force of the screw propeller conveying mechanism 31 is reduced, and the amount of ice transferred to the ice/chilled water mixing chamber 35 relatively diminishes. By virtue of this function, the mixing proportion of the ice fragments and chilled water may be adjusted.

From the above description, it may be seen that application of the ice crushing and feeding device in the dynamic ice making apparatus of the present invention has the following advantages:

1. The dynamic ice making apparatus may be adapted for use in multiple ice storage systems, and the ice making apparatus may not necessarily be located above the ice storage tanks, enhancing the flexibility and efficiency of use of building space.
2. The mixture of ice fragments and chilled water may be maintained in an appropriate proportion so as to prevent the feed pump from being clogged by ice fragments when they are too numerous, and to ensure that an adequate amount of ice is transferred to the ice storage tanks.
3. The size of the ice fragments obtained by means of the crushing mechanism is very small so that they may not affect the pump's performance or cause clogging. Because ice fragments have greater contact surfaces which may accelerate melting to release heat, the ice is prevented from piling into a heap in a storage tank.
4. Because the head pressure generated by the pump itself may have a considerable impact on the ice storage tank when the ice fragments it carries are deposited in the storage tank, the force of impact helps to distribute the ice fragments evenly in the storage tank. With a suitable piping arrangement, the problem of ice piling up in a heap in the storage tank as in the conventional apparatus may be eliminated, hence increasing the capacity of the storage tank; relatively, the depth and size of the storage tank may also be reduced.

Although the present invention has been illustrated and described with reference to the preferred embodiment thereof, it should be understood that it is in no way limited to the details of such embodiment but is capable of numerous modifications within the scope of the appended claims.

What is claimed is:

1. An ice crushing and feeding device which is adapted for installation below a dynamic ice making apparatus for crushing ice formed by said dynamic ice making apparatus into ice fragments of an appropriate size, wherein said ice crushing and feeding device comprises:

an ice receiving means located below said dynamic ice making apparatus, an ice conveying mechanism within said ice receiving means, a speed control device for said ice conveying mechanism, said ice conveying mechanism operating at a speed regulated and controlled by said speed control device, an ice crushing mechanism provided at one end of said ice conveying means, an ice/chilled water mixing chamber attached to said ice crushing mechanism, and a feed pump attached to said mixing chamber for pumping said ice-water mixture outwardly from said mixing chamber.

2. An ice crushing and feeding device which is adapted for installation below a dynamic ice making apparatus for crushing ice formed by said dynamic ice making apparatus into ice fragments of an appropriate size, wherein said ice crushing and feeding device comprises:

an ice receiving means located below said dynamic ice making apparatus, an ice conveying mechanism within said ice receiving means, an ice crushing mechanism provided at one end of said ice conveying means, said ice crushing mechanism having a set of rollers in which one of said rollers rotates in a clockwise direction, the other of said rollers rotates in a counterclockwise direction, whereby ice is drawn in between said rollers to be crushed into fine ice fragments, an ice/chilled water mixing chamber attached to said ice crushing mechanism, and a feed pump attached to said mixing chamber for pumping said ice-water mixture outwardly from said mixing chamber.

3. An ice crushing and feeding device which is adapted for installation below a dynamic ice making apparatus for crushing ice formed by said dynamic ice making apparatus into ice fragments of an appropriate size, wherein said ice crushing and feeding device comprises:

an ice receiving means located below said dynamic ice making apparatus, an ice conveying mechanism within said ice receiving means, an ice crushing mechanism provided at one end of said ice conveying means, an ice/chilled water mixing chamber attached to an outlet of said ice crushing mechanism, a chilled water storage tank attached to said ice/chilled water mixing chamber, said chilled water storage tank having a hole in communication with said ice/chilled water mixing chamber, said ice/chilled water mixing chamber positioned below a water level of said chilled water storage tank, a feed pump attached to said mixing chamber for pumping said ice-water mixture out of said mixing chamber, an ice storage tank, and a distribution duct attached to said feed pump and communicating with said ice storage tank, said distribution duct conveying said ice-water mixture from said pump into said ice storage tank.

4. An ice crushing and feeding device as defined in claim 3, wherein said distribution duct attached to said feed pump communicates with a plurality of ice storage tanks, said distribution duct conveying said ice-water mixture from said feed pump into said storage tanks.

5. An ice crushing and feeding device which is adapted for installation below a dynamic ice making apparatus for crushing ice formed by said dynamic ice making apparatus into ice fragments of an appropriate size, wherein said ice crushing and feeding device comprises:

an ice receiving means located below said dynamic ice making apparatus, an ice conveying mechanism within said ice receiving means, an ice crushing mechanism provided at one end of said ice conveying means, an ice/chilled water mixing chamber attached to said ice crushing mechanism, a chilled water storage tank attached to said ice/chilled water mixing chamber and below said ice receiving means, said chilled water storage tank having a float valve and a hole in communication with said ice/chilled water mixing chamber, said float valve controlling a level of chilled water in said chilled water storage tank for supplying a stable amount of chilled water to said ice/chilled water mixing chamber, and a feed pump attached to said mixing chamber for pumping said ice-water mixture out of said mixing chamber.

6. An ice crushing and feeding device which is adapted for installation below a dynamic ice making apparatus for crushing ice formed by said dynamic ice making apparatus into ice fragments of an appropriate size, wherein said ice crushing and feeding device comprises:

an ice receiving means located below said dynamic ice making apparatus, an ice conveying mechanism within said ice receiving means, an ice crushing mechanism provided at one end of said ice conveying means, an ice/chilled water mixing chamber attached to said ice crushing mechanism, a chilled water storage tank attached to said ice/chilled water mixing chamber, said chilled water storage tank having an inlet hole in communication with said ice/chilled water mixing chamber for permitting the entrance of chilled water but not ice fragments into said chilled water storage tank, and a feed pump attached to said mixing chamber for pumping said ice-water mixture out of said mixing chamber.

7. An ice crushing and feeding device which is adapted for installation below a dynamic ice making apparatus for crushing ice formed by said dynamic ice making apparatus into ice fragments of an appropriate size, wherein said ice crushing and feeding device comprises:

an ice receiving means located below said dynamic ice making apparatus, an ice conveying mechanism within said ice receiving means, an ice crushing mechanism provided at one end of said ice conveying means, an ice/chilled water mixing chamber attached to said ice crushing mechanism, a chilled water storage tank attached to said ice/chilled water mixing chamber, said chilled water storage tank having a hole in communication with said ice/chilled water mixing chamber, a feed pump attached to said mixing chamber for pumping said ice-water mixture out of said mixing chamber; and said dynamic ice making apparatus installed on a floor of a building, and said ice crushing and feeding device disposed in a raft foundation of the building.

8. An ice crushing and feeding device as claimed in claim 7 wherein said receiving means has holes big enough for chilled water to flow through but not ice fragments.

9. An ice crushing and feeding device as defined in claim 6, wherein said ice receiving means comprising two obliquely disposed plates in a V-shaped arrangement disposed on a semi-spherical bottom shell.

10. An ice crushing and feeding device as claimed in claim 9 wherein said semi-spherical bottom shell has holes big enough for chilled water to flow through but ice fragments.

11. An ice crushing and feeding device as defined in claim 6, wherein said conveying means within said ice receiving means is a rotatable screw propeller rod.

12. An ice crushing and feeding device as defined in claim 9, wherein said conveying means within said ice receiving means is a rotatable screw propeller rod.

* * * * *